US010215201B2

(12) United States Patent
Xu

(10) Patent No.: US 10,215,201 B2
(45) Date of Patent: Feb. 26, 2019

(54) COLUMN TYPE HYDRAULIC TAPPET

(71) Applicant: Hangzhou XZB Tech Co., Ltd., Hangzhou (CN)

(72) Inventor: Na Xu, Hangzhou (CN)

(73) Assignee: HANGZHOU XZB TECH CO., LTD., Hangzhou (CN)

( * ) Notice: Subject to any disclaimer, the term of this patent is extended or adjusted under 35 U.S.C. 154(b) by 784 days.

(21) Appl. No.: 14/765,038

(22) PCT Filed: May 20, 2014

(86) PCT No.: PCT/CN2014/077844
§ 371 (c)(1),
(2) Date: Jul. 31, 2015

(87) PCT Pub. No.: WO2015/143764
PCT Pub. Date: Oct. 1, 2015

(65) Prior Publication Data

US 2016/0238044 A1 Aug. 18, 2016

(30) Foreign Application Priority Data

Mar. 24, 2014 (CN) ..... 2014 1 0112660

(51) Int. Cl.
*F01L 1/14* (2006.01)
*F15B 15/14* (2006.01)
(Continued)

(52) U.S. Cl.
CPC ..... *F15B 15/1447* (2013.01); *F01L 1/146* (2013.01); *F01L 1/24* (2013.01);
(Continued)

(58) Field of Classification Search
CPC ..... F01L 1/24; F01L 1/2405; F01L 2103/00; F01L 2820/01; F15B 15/1447
(Continued)

(56) References Cited

U.S. PATENT DOCUMENTS 7,779,805 B2 * 8/2010 Katsumata ..... F01L 1/2405 123/90.52
2009/0031969 A1 2/2009 Bugescu et al.

FOREIGN PATENT DOCUMENTS

CN 201228569 Y 4/2009
CN 101684738 A 3/2010
(Continued)

OTHER PUBLICATIONS

International Search Report issued in corresponding PCT Application No. PCT/CN2014/077844 dated Jan. 4, 2015 (3 pages).
(Continued)

*Primary Examiner* — Ching Chang
(74) *Attorney, Agent, or Firm* — Liang Legal Group, PLLC

(57) ABSTRACT

A column type hydraulic tappet includes a housing; a plunger correspondingly installed in the housing; and a high pressure chamber for a hydraulic medium formed between the bottom face of the plunger and the bottom of the housing and is sealed by a check valve opening toward the high pressure chamber. The housing includes an external circumferential groove on the outer diameter for passing the hydraulic medium and an inner circumferential groove on the inner diameter for passing the hydraulic medium. One or more housing oil holes are disposed between the outer circumferential groove and the inner circumferential groove. The plunger includes a sealed hemisphere head portion, a shaft portion and a body portion. An indent neck portion between the head and shaft portions of the plunger has a wall thickness 105%-120% of the wall thickness of the other portions of the plunger.

12 Claims, 7 Drawing Sheets

(51) Int. Cl.
*F01L 1/24* (2006.01)
*F01L 9/02* (2006.01)
*F15B 1/26* (2006.01)

(52) U.S. Cl.
CPC ..... *F01L 1/2405* (2013.01); *F01L 9/02* (2013.01); *F15B 1/26* (2013.01); *F15B 15/1428* (2013.01); *F01L 2103/00* (2013.01); *F01L 2820/01* (2013.01)

(58) Field of Classification Search
USPC ..... 123/90.48, 90.52, 90.55
See application file for complete search history.

(56) References Cited

FOREIGN PATENT DOCUMENTS

| | | | |
|---|---|---|---|
| CN | 201593451 | U | 9/2010 |
| CN | 102767405 | A | 11/2012 |
| CN | 102788154 | A | 11/2012 |
| CN | 203783666 | U | 8/2014 |
| DE | 102007033757 | A1 | 1/2009 |
| DE | 102012200754 | A1 | 7/2013 |
| DE | 102012204622 | A1 | 10/2013 |

OTHER PUBLICATIONS

Written Opinion issued in corresponding PCT Application No. PCT/CN2014/077844 dated Jan. 4, 2015 (4 pages).

* cited by examiner

COLUMN TYPE HYDRAULIC TAPPET

CROSS REFERENCE TO RELATED APPLICATIONS

This is a national stage application based on PCT/CN2014/077844, filed on May 20, 2014. This application claims the benefit and priority of this prior application and incorporates its disclosures by reference in its entirety.

FIELD OF THE INVENTION

The present invention relates to a column type hydraulic tappet.

BACKGROUND

Hydraulic tappet (hydraulic valve lifter) can be used to automatically compensate for valve lash (valve clearance), to reduce shock and noise of valve train (valve gear), to reduce abrasion or wear of working surfaces of the valve train, and to improve emission and combustion efficiency of thane engine.

The structures of existing hydraulic tappets include several different types as disclosed in the prior art.

As shown in FIG. 1, Chinese patent publication CN201593451U discloses a hydraulic support element, wherein the plunger is machined after cold heading. The machining processes are complicated, and these processes take time and efforts. After the process cutting off material to make the neck portion of the plunger, the metal flow line of the material is cut off. The thickness of the neck is smaller than those of other portions. The sizes of the two cross-sections abruptly change leading to concentration of reactive forces. This greatly impacts the overall strength of the plunger.

As shown in FIG. 2, Chinese patent publication CN201228569Y discloses a hydraulic support element, wherein the plunger comprises a narrow V-shaped circumferential groove on the external diameter, and an oil hole is opened above the V-shaped circumferential groove. A drawback of the V-shaped circumferential groove structure is that when an upper limit clamp spring is assembled, the clamp spring can only slide up and down with the plunger, and may cause fracture on abrasion faces. The position of the oil hole is on an external cylinder surface above the V-shaped groove. When a hydraulic medium passes through the small hole, impurities contained in the hydraulic medium may enter the gap between the housing and the plunger, causing the hydraulic tappet to stuck and lose automatic regulation function.

As shown in FIG. 3, Chinese patent publication CN102767405 discloses a hydraulic support element, wherein the plunger comprises two components. Each single component is easier to machine. However, because two components are machined separately, the production costs are higher. Especially, a variation of the two contact end faces must meet a strict requirement. If the variation is over a tolerance range, a lateral force will be generated, and the plunger may be stuck in the housing, impacting the function of the product.

Chinese patent publication CN102788154 discloses an integral type hydraulic tappet plunger and a method of integral roll forming thereof. A ball portion, a shaft portion and a body portion are formed as a unitary body and have the same wall thickness. Thus, this solves the technical defects of the split type plunger and the traditional machining plunger.

However, after research and investigation, the present inventors found that stresses at different locations on the plunger are not homogeneous. Especially, the head and neck portions are key areas of stress, where lies the hidden danger of stress fatigue. Although the overall strength of the plunger is increased by using the equal wall thickness integral forming process, the technical problems of stress concentration is not solved.

SUMMARY OF THE INVENTION

An object of the present invention is to provide a hydraulic tappet that comprises a unitary type plunger having a simple and reliable structure, wherein wall thickness at the weak area in the unitary thin wall hollow plunger is increased. At the same time, the oil storage capacity of the inner chamber is increased and the fatigue strength of the plunger is improved.

Embodiments of the present invention are as follows:

A column type hydraulic tappet comprises a housing; a plunger correspondingly installed in the housing; and a high pressure chamber for a hydraulic medium formed between the bottom face of the plunger and the bottom of the housing. The high pressure chamber is sealed by a check valve opening toward the high pressure chamber. The housing includes an external circumferential groove on the outer diameter for passing the hydraulic medium and an inner circumferential groove on the inner diameter for passing the hydraulic medium. One or more housing oil holes are disposed between the outer circumferential groove and the inner circumferential groove. The plunger comprises a sealed hemisphere head portion, a shaft portion and a body portion, characterized in that an indent (narrower) neck portion is disposed between the head and shaft portions of the plunger, and the wall thickness of the neck portion is 105%-120% of the wall thickness of the other portions of the plunger.

After research, the inventors found that the neck and head portions are weak areas of the plunger and are prone to damages due to fatigue.

A plunger of embodiments of the invention, having an increased wall thickness at the neck portion, can circumvent the technical problem of low strength due to fatigue (i.e., low fatigue strength) because the neck portion is too thin. Embodiments of the invention based on increased wall thickness can improve the fatigue strength of hydraulic tappets to ensure sufficient safety coefficient. If the wall is too thick, it is hard to machine and manufacture, the weight of products will increase substantially, and it is against lightweight requirements of the products.

The thickness is increased by roll forming (rolling press process) after cold heading. During roll forming, the plunger is compressed in the axial direction by using a mold. The mold limits the flow of the metal material in the axial direction, thereby the material can only flow on a radial direction to increase the thickness of the neck portion after roll forming.

Preferably, the wall thickness of the head portion of a plunger is 105%-120% of the wall thickness of the other portions of the plunger. These embodiments provide plungers having an increased wall thickness at the ball head portion to avoid problems arising from low fatigue strength due to the head portion being too thin. In accordance with embodiments of the invention, based on increased wall thickness, the fatigue strengths of hydraulic tappets are increased to ensure sufficient safety coefficient. If the wall is too thick, it is hard to machine and manufacture, the weight of products will increase substantially, and it is against the lightweight requirements of the products.

The thickness is increased by roll forming (rolling press process) after cold heading. During cold heading, the ball head portion is preshrunk to limit the flow of the metal material in the axial direction in order to increase the thickness of the head portion.

Preferably, the plunger is formed by roll forming after cold heading. An indent wide circumferential (ring) groove is disposed on an external diameter of the plunger at a location corresponding to an inner circumferential groove of the housing. One or more oil holes are disposed in the indent wide circumferential groove. The hydraulic medium can flow into an oil reservoir of the plunger through the oil holes. The width of the bottom of the indent wide circumferential groove is not less than the diameter of the oil hole of the plunger, and the centers of all oil holes are located above the midline of the indent wide circumferential groove.

Chinese Patent CN201228569Y discloses:

1. A plunger having a deflecting element. The drawback of this plunger is that the plunger cannot be made in a single machining process. Instead, multi-processes are required. It is time-consuming and labor intensive. There is a small gap between the plunger and the chamber of the plunger, and the impurities produced during the heat treatment and subsequent machining are difficult to remove.

2. The drawback of a V-shaped circumferential groove is that when a limit clamp spring is assembled, the clamp spring can only slide up and down with the plunger, leading to significant friction and may result in fracture of abrasion wear face on the clamp spring. If the oil holes are formed by punching holes, the external diameter may deform due to punching. This would impede the subsequent grinding processing. Therefore, viable methods include only milling, drilling, or processing using laser or electricity. These processes are slow and expensive.

In contrast, the indent wide circumferential groove of the present invention has a simple structure and is easy to machine. The oil holes are located in the indent wide circumferential groove and are suitable to be made by punching process. The clamp spring is not forced to slide up and down with the plunger, effectively solving the problems in the prior art.

Compared with the prior art plungers, the plungers of the present invention are formed by cold heading and can overcome low fatigue strength of the prior plungers that are produced by cutting and result in disrupted metal fibers.

Preferably, the minimal diameter of the neck portion of a plunger is 0.5-1.0 mm smaller than the diameter of the ball head. If the diameter of the neck portion is too much smaller than the diameter of the ball head, it is more difficulty to form the neck portion, and the useful life of the mold is decreased. And if the diameter of the neck portion is insufficiently smaller than the diameter of the ball head, the ball head is prone to fall off from the locking plate for the ball head.

Preferably, the width of the groove bottom of an indent wide circumferential groove is 1.5-3.0 mm, and the depth of the groove is 0.2-1.0 mm. The plunger oil holes can be completely distributed in the indent wide circumferential groove. If the oil holes are formed by punching process, the boundary of the hole is tangent to the top transition include surface of the indent wide circumferential groove. If the oil holes are formed by electromachining, the oil holes can be distributed on the transition incline surface of the indent wide circumferential groove. This is to make the oil holes higher for a bigger capacity of the oil reservoir to store more hydraulic medium. These processes avoid the technical problems associated with machining the oil holes on the external diameter of the plunger that requires sliding fit.

An indent wide circumferential groove having a size in accordance with embodiments of the present invention is easy to process and meets the flow cross section requirements of the hydraulic medium. Too deep or too wide a groove would be difficult to machine.

Preferably, the sealed base of the plunger comprises an orientation surface indented towards the oil reservoir, which is used for orienting a steel ball. When the orientation surface is an arc surface, its radius r is 0.3-0.8 mm. When the orientation surface is a conical surface, the taper angle of the cone $\beta$ is 60°-120°. The orientation surface can also be a parabolic surface or other transition surface of a closed structure, such as a coalition of arc and cone.

LIST OF REFERENCE NUMBERS

1. plunger;

2. housing;

3. check valve;

4. neck portion;

5. indent wide circumferential groove of the plunger;

6. oil hole of the plunger;

7. oil hole of the housing;

8. inner ring groove of the housing;

9. oil reservoir;

10. high pressure chamber;

11. head portion;

12. bottom cant of the ring groove of the plunger;

13. external ring groove of the housing;
14. return spring;
15. locating surface.

DETAILED DESCRIPTION OF THE INVENTION

Embodiments of the invention will be further described together with the drawings.

Embodiment I

Figure 1:
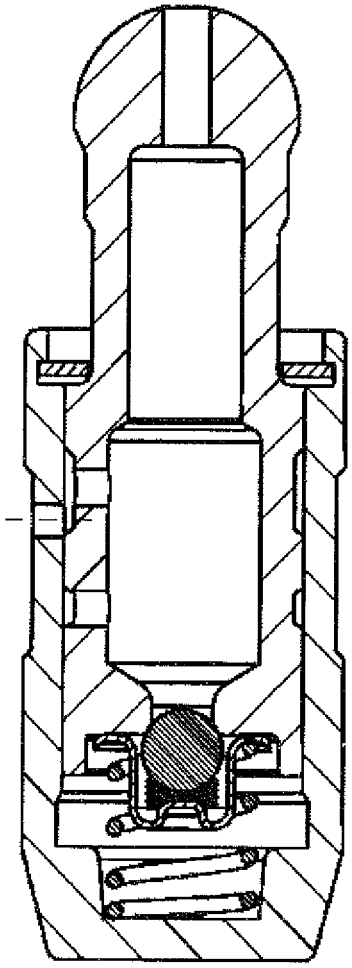
Fig. 1 (Prior Art)
FIG. 1 illustrates a hydraulic tappet structure of prior art I
Figure 2:
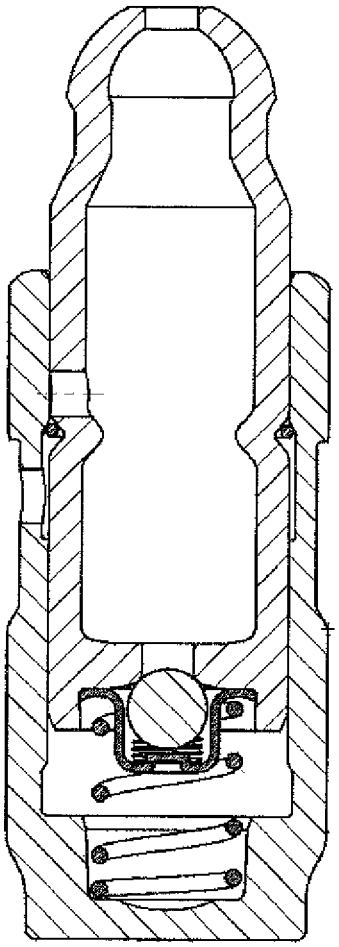
Fig. 2 (Prior Art)
FIG. 2 illustrates a hydraulic tappet structure of prior art II
Figure 3:
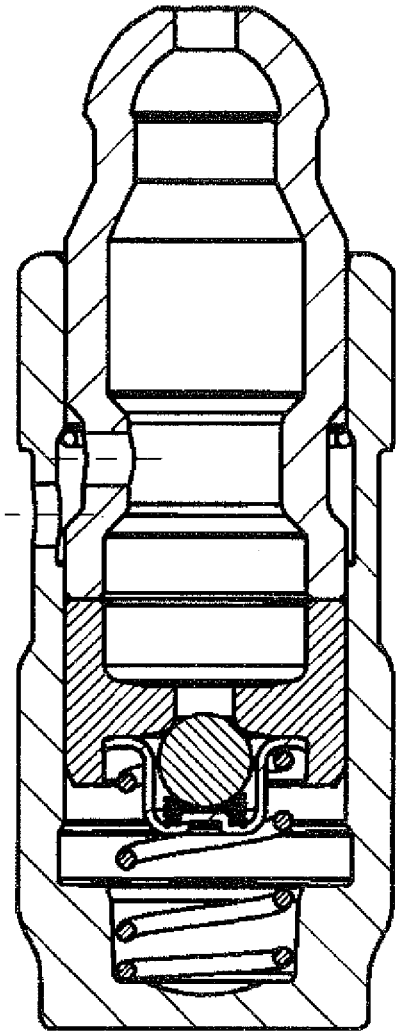
Fig. 3 (Prior Art)
FIG. 3 illustrates a hydraulic tappet structure of prior art III
Figure 4:
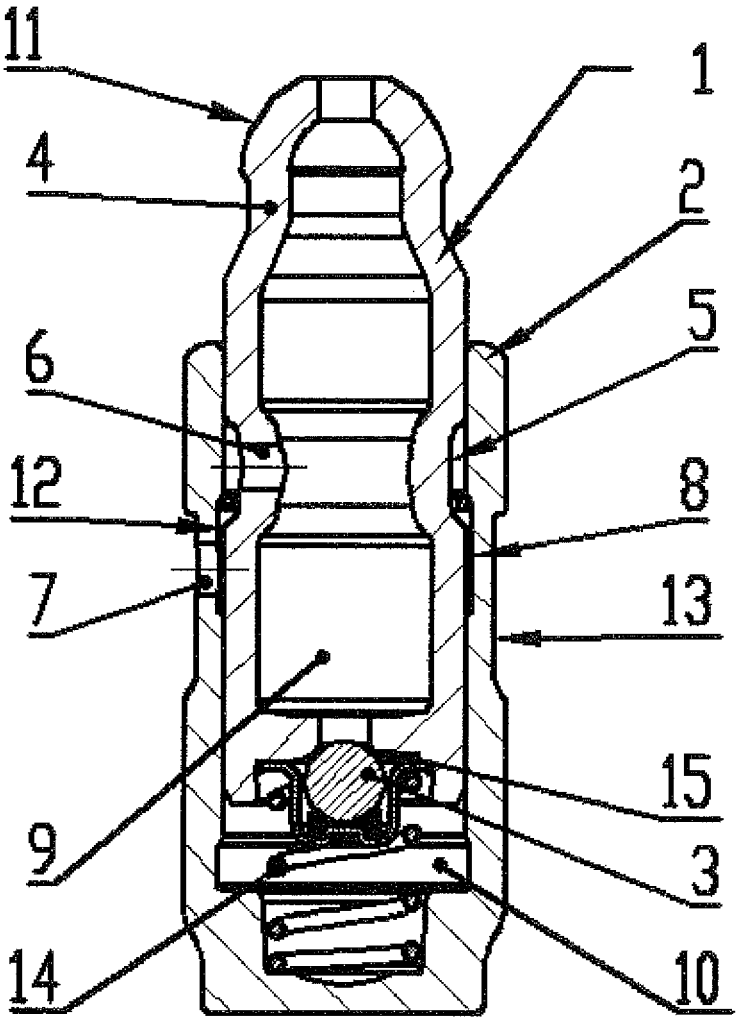
FIG. 4 illustrates a hydraulic tappet structure in accordance with Embodiment I of the present invention

As shown in FIG. 4, a hydraulic tappet for a valve drive of an internal combustion engine comprises a cylindrical housing (2); an axial slidable plunger (1) installed in the housing. A high pressure chamber (10) for a hydraulic medium is located between a bottom face of plunger (1) and a bottom of housing (2), which can be sealed by an one-way check valve (3) located in a lower section of plunger (1). The housing (2) includes an external ring (circumferential) groove (13) on an external diameter for passing the hydraulic medium. An inner ring (circumferential) groove (8) for passing the hydraulic medium is located on an inner diameter of the housing, and one or more oil holes (7) are located between the two circumferential grooves for connecting the two circumferential grooves.

The plunger includes an indent wide circumferential groove (5), and one or more oil holes (6) are located in the indent wide circumferential groove (5). An inner circumferential groove (8) of the housing is in communication with indent wide circumferential groove (5) of the plunger. The hydraulic medium may be transferred into an oil reservoir (9) through the oil holes on the plunger (6).

In accordance with one embodiment of the invention, a head portion (11), a shaft portion and a body portion of the plunger is formed integrally. An indent neck portion (4) is located between head portion (11) and the shaft portion of the plunger. The neck portion serves to facilitate fixing of a locking plate, which connects with a roller rocker to prevent falling off.

The indent wide circumferential groove (5) includes a lower slope (incline surface) for limiting a free movement up and down distance of the hydraulic tappet.

The wall thicknesses of the head portion (11), the neck portion and indent wide circumferential groove (5) are 105%-120% of the wall thickness of the other portions of the plunger.

The diameter of neck portion (4) of the plunger is 0.5-1.0 mm smaller than the diameter of the ball head.

The width of the groove bottom of the indent wide circumferential groove (5) is 1.5-3.0 mm, and the depth of the groove is 0.2-1.0 mm.

Embodiment II

Figure 5:
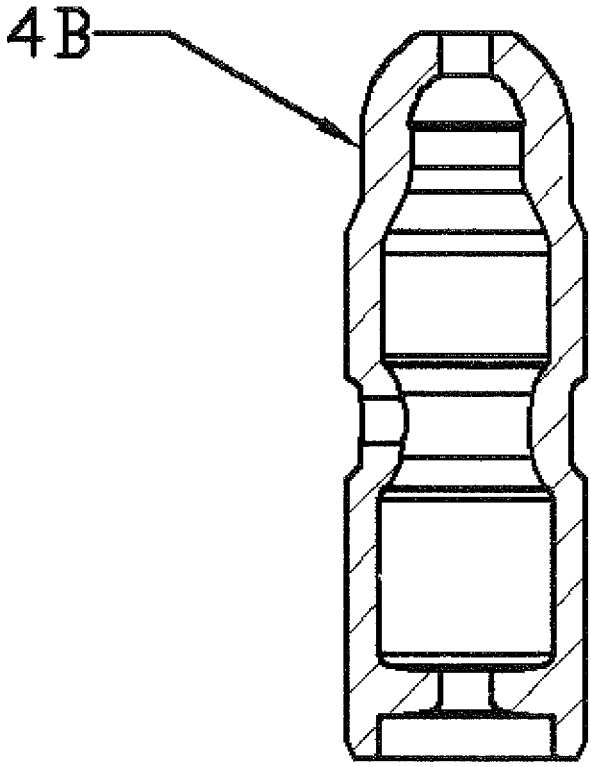
FIG. 5 illustrates a hydraulic tappet structure in accordance with Embodiment II of the present invention

Unlike Embodiment I, as shown in FIG. 5, in the second embodiment, a smooth neck portion (4B) is located between the head portion (11) and the shaft portion.

Embodiment III

Figure 6:
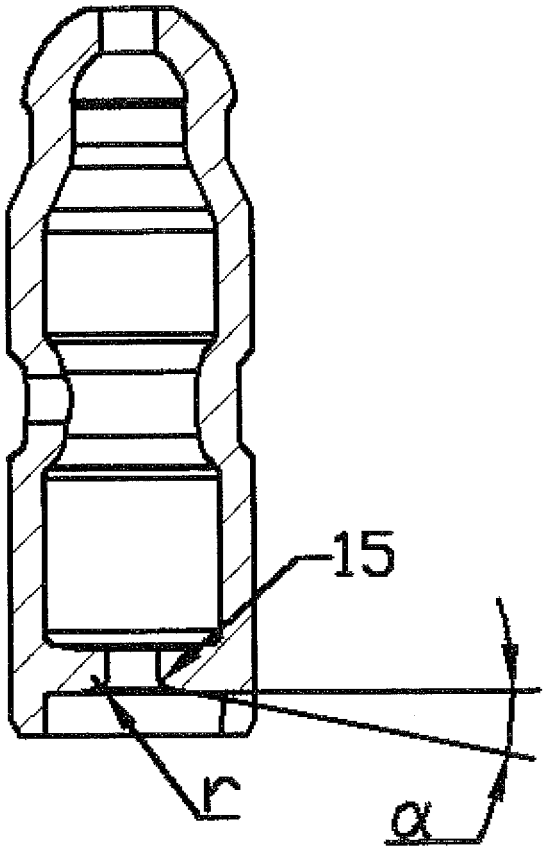
FIG. 6 illustrates a hydraulic tappet structure in accordance with Embodiment III of the present invention

Unlike Embodiment I, as shown in FIG. 6, in the third embodiment, an orientation surface (15) of the plunger is a coalition of an arc surface and a conical surface, wherein the arc surface has a radius r of 0.3-0.8 mm and the conical surface has a conical (taper) angle $\alpha$ of 5°-15°.

Embodiment IV

Figure 7:
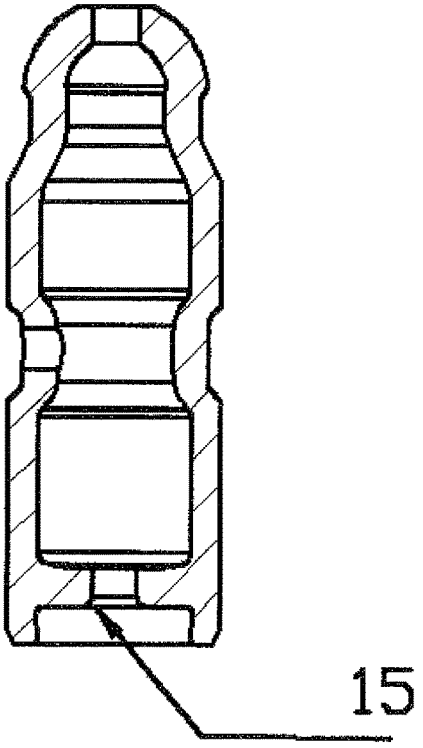
FIG. 7 illustrates a hydraulic tappet structure in accordance with Embodiment IV of the present invention

Unlike Embodiment I, as shown in FIG. 7, in the fourth embodiment, an orientation surface (15) of the plunger is an arc surface having a radius r of 0.3-0.8 mm.

Embodiment V

Figure 8:
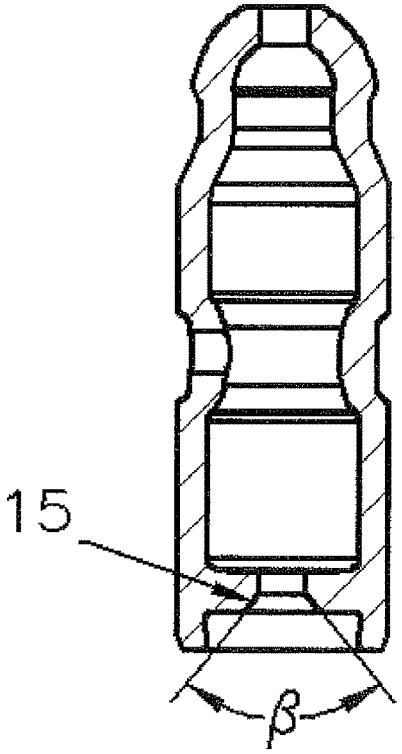
FIG. 8 illustrates a hydraulic tappet structure in accordance with Embodiment IV of the present invention
Figure 9:
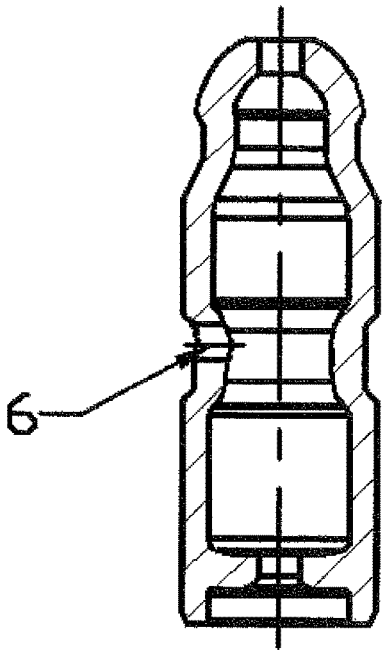
FIG. 9 illustrates a detailed punching position of an oil hole in accordance with one embodiment of the present invention
Figure 10:
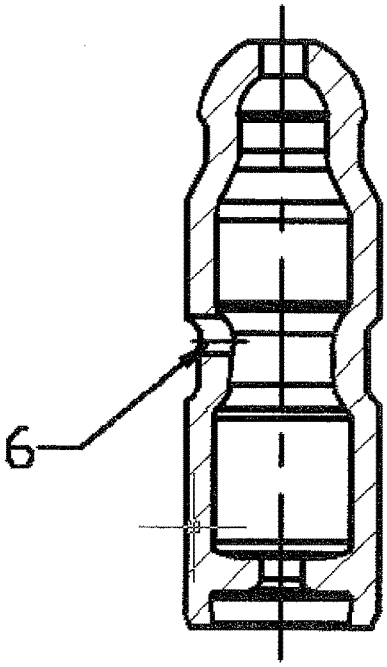
FIG. 10 illustrates a detailed electromachining position of an oil hole in accordance with one embodiment of the present invention

Unlike Embodiment I, as shown in FIG. 8, in the fifth embodiment, an orientation surface (15) of the plunger is a conical surface having a conical (taper) angle $\beta$ of 60°-120°.

What is claimed is:

1. A column type hydraulic tappet, comprising:

a housing, wherein the housing comprises an external circumferential groove disposed on an outer diameter for passing a hydraulic medium, and an inner circumferential groove disposed on an inner diameter for passing the hydraulic medium, and wherein one or more oil holes are disposed between the external circumferential groove and the inner circumferential groove of the housing;

a plunger correspondingly installed in the housing, wherein the plunger comprises a sealed hemisphere head portion, a shaft portion, and a body portion, wherein an indent neck portion is formed between the sealed hemisphere head portion and the shaft portion of the plunger, and wherein a wall thickness of the indent neck portion is 105%-120% of a wall thickness of other portions of the plunger; and a high-pressure chamber for the hydraulic medium thrilled between a sealed base of the plunger and a bottom of the housing, wherein the high-pressure chamber is sealed by a check valve opening towards the high-pressure chamber.

2. The column type hydraulic tappet according to claim 1, wherein the wall thickness of the sealed hemisphere head portion of the plunger is 105%-120% of the wall thickness of other portions of the plunger.

3. The column type hydraulic tappet according to claim 2, wherein the thickness of the sealed hemisphere head portion is increased by rolling press process after cold heading, wherein during the cold heading, the head portion is pre-shrunk to limit the flow of the metal material in an axial direction to increase the thickness of the sealed hemisphere head portion.

4. The column type hydraulic tappet according to claim 2, wherein an indent wide circumferential groove is disposed on an external diameter of the plunger at a location corresponding to the inner circumferential groove of the housing, wherein one or more oil holes are disposed in the indent wide circumferential groove such that the hydraulic medium can pass into an oil reservoir of the plunger, wherein a width at a groove bottom of the indent circumferential groove is not less than diameters of the one or more oil holes of the plunger such that centers of the one or more oil holes are located above a midline of the indent wide circumferential groove.

5. The column type hydraulic tappet according to claim 2, wherein a minimal diameter of the indent neck portion of the plunger is 0.5-1.0 mm less than a diameter of the sealed hemisphere head portion.

6. The column type hydraulic tappet according to claim 1, wherein the thickness of the indent neck portion is increased by rolling press process after cold heading, wherein during the rolling press process, the plunger is compressed in an axial direction by using a mold, thereby limiting a flow of a metal material in the axial direction such that the metal material can only flow in a radial direction to increase the thickness of the indent neck portion after the rolling press process.

7. The column type hydraulic tappet according to claim 1, wherein an indent wide circumferential groove is disposed on an external diameter of the plunger at a location corresponding to the inner circumferential groove of the housing, wherein one or more oil holes are disposed in the indent wide circumferential groove such that the hydraulic medium can pass into an oil reservoir of the plunger, wherein a width at a groove bottom of the indent circumferential groove is not less than diameters of the one or more oil holes of the plunger such that centers of the one or more oil holes are located above a midline of the indent wide circumferential groove.

8. The column type hydraulic tappet according to claim 7, wherein the width at the groove bottom of the indent wide circumferential groove is 1.5-3.0 mm, and a depth of the indent wide circumferential groove is 0.2-1.0 mm.

9. The column type hydraulic tappet according to claim 7, wherein the one or more oil holes are formed by punching process or electromachining, wherein when the one or more oil holes are formed by the punching process, borders of the oil holes are tangent to a top transition incline surface of the indent wide circumferential groove; wherein when the one or more oil holes are formed by electromachining, the one or more oil holes are distributed on the top transition incline surface of the indent wide circumferential groove.

10. The column type hydraulic tappet according to claim 1, wherein a minimal diameter of the indent neck portion of the plunger is 0.5-1.0 mm less than a diameter of the sealed hemisphere head portion.

11. The column type hydraulic tappet according to claim 1, wherein the indent wide circumferential groove includes a lower incline surface for limiting a free movement up and down distance of the plunger.

12. The column type hydraulic tappet according to claim 1, wherein the sealed base comprises an orientation surface indented towards the oil reservoir, wherein if the orientation surface is an arc surface, a radius of which is 0.3-0.8 mm, wherein if the orientation surface is a coalition of an arc surface and a conical surface, then a radius r of the arc surface is 0.3-0.8 mm, and a conical angle a of the conical surface is 5°-15°.

* * * * *